United States Patent [19]

Deve

[11] Patent Number: 4,533,087

[45] Date of Patent: Aug. 6, 1985

[54] APPARATUS WITH HEAT EXCHANGE MEANS AND TRANSFER PIPE FOR TREATING SOLID, GRANULAR AND AGGREGATE MATERIALS

[75] Inventor: Vagn Deve, East Washington, Pa.

[73] Assignee: Combustion Engineering, Inc., Windsor, Conn.

[21] Appl. No.: 521,494

[22] Filed: Aug. 8, 1983

[51] Int. Cl.[3] ..... B02C 19/12

[52] U.S. Cl. ..... 241/65; 241/69; 241/DIG. 10

[58] Field of Search ..... 241/65, 66, 67, DIG. 10, 241/71, 72, 69, 101 B; 164/5, 412

[56] References Cited

U.S. PATENT DOCUMENTS

| | | | |
|---|---|---|---|
| 2,881,571 | 4/1959 | Granata | 241/65 X |
| 3,243,128 | 3/1966 | Tight | 241/65 |
| 3,785,575 | 1/1974 | Langmaack et al. | 241/65 X |
| 4,059,232 | 11/1977 | Engels | 241/67 X |

*Primary Examiner*—Mark Rosenbaum

*Attorney, Agent, or Firm*—Arthur E. Fournier, Jr.

[57] ABSTRACT

An apparatus (14) embodying heat exchange means for treating solid, granular and aggregate materials, and in particular for treating spent, i.e., used, chemically bonded foundry sand. The subject apparatus (14) includes a rotatable first chamber means (16) and a rotatable second chamber means (30). The used foundry sand is preheated while traveling from one end thereof to the other end thereof through the first and second chamber means (16, 30). From the second chamber means (30) the preheated used foundry sand is suitably conveyed to a thermal reclaimer means (12) for purposes of thermally removing organic matter therefrom. Thereafter, the used foundry sand is conveyed to a fluidizing chamber means (48) which is located in surrounding heat exchange relation to the first chamber means (16). As the used foundry sand flows in a second direction through the fluidizing chamber means (48), heat is exchanged between the foundry sand traveling through the fluidizing chamber means (48) and the foundry sand traveling through the first chamber means (16) such that the former loses heat, i.e., is being cooled, and the latter absorbs heat, i.e., is being preheated.

7 Claims, 3 Drawing Figures

APPARATUS WITH HEAT EXCHANGE MEANS AND TRANSFER PIPE FOR TREATING SOLID, GRANULAR AND AGGREGATE MATERIALS

CROSS-REFERENCE TO RELATED APPLICATIONS

This application is hereby cross-referenced to the following five previously filed patent applications which are commonly assigned: U.S. patent application Ser. No. 369,069, filed Apr. 16, 1982, entitled "Thermal Sand Reclamation System", filed in the name of Vagn Deve which issued on Dec. 11, 1984 as U.S. Pat. No. 4,487,372; U.S. patent application Ser. No. 369,068, filed Apr. 16, 1982, entitled "A Lump-Crusher And Shake-Out Apparatus For A Thermal Sand Reclamation System", Filed in the name of Vagn Deve; U.S. patent application Ser. No. 369,334, filed Apr. 16, 1982, entitled "Thermal Reclaimer Apparatus For A Thermal Sand Reclamation System", filed in the name of Vagn Deve which issued on Feb. 7, 1984 as U.S. Pat. No. 4,429,642; U.S. patent application Ser. No. 369,476, filed Apr. 16, 1982, entitled "A Post Reclaimer, Cooling And Separator Assembly For A Thermal Sand Reclamation System", filed in the name of Vagn Deve and now abandoned; and U.S. patent application Ser. No. 369,335, filed Apr. 16, 1982, entitled "A Classifying Scrubber And Cooling Assembly For A Thermal Sand Reclamation System", filed in the name of Vagn Deve and now abandoned. In addition, this application is hereby cross-referenced to the following patent application which was commonly filed herewith and which is commonly assigned: U.S. patent application Ser. No. 521,498, filed Aug. 8, 1983, entitled "Apparatus With Heat Exchange Means For Treating Solid, Granular And Aggregate Material", filed in the name of Vagn Deve.

BACKGROUND OF THE INVENTION

This invention relates to apparatus for treating solid, granular and aggregate materials and in particular to an apparatus for accomplishing the preheating, post reclamation and cooling of spent, i.e., used, chemically bonded foundry sand.

Although most people do not commonly view sand as being one of our Nation's diminishing natural resources, to those in the foundry field the shrinking supply of sand of the kind that is suitable for use for foundry purposes is a matter of concern. More specifically, despite the fact that some kinds of sand may be considered to be in relatively plentiful supply, the specific type of sand which is capable of being employed for purposes of making castings through the use of processes associated with foundry operations is, generally speaking, in relatively short supply. That is, the latter type of sand, which for ease of reference will hereinafter be referred to generically by the term "foundry sand" occurs naturally in only selected locations. Accordingly, as the foundry sand continues to be removed from any given one of these selected locations, the supply of foundry sand thereat eventually becomes exhausted. This is precisely what is taking place more and more frequently these days. As a consequence, those employed in the foundry industry who are responsible for acquiring supplies of foundry sand are reaching the point where they can no longer satisfy their requirements for foundry sand simply from local sources. Rather, they are being forced to seek supplies of foundry sand from sources located at ever increasing distances from the site of the foundry at which it is intended to make use of the foundry sand.

Apart from that concern to which reference has been had hereinbefore, which those in the foundry field have with regard to the fact that available sources of supply of foundry sand are becoming fewer and fewer in number, there is yet another matter, which is of concern to those in the foundry industry. This is the matter of the increasing rise in the price of the foundry sand which is available. This increase in the cost of obtaining adequate supplies of foundry sand appears to be occasioned basically by three factors.

The first of these is the fact that sources of supply of available foundry sand are located further and further away from the individual foundry sites. Thus, that segment of the price of foundry sand which is represented by the cost of transporting the foundry sand to the foundry site is becoming a more and more significant factor in the overall cost of obtaining the foundry sand.

The second is a function of the fact that foundry sand is in dwindling supply. Namely, one finds that in the case of most items, as the item becomes less and less available, the price of the item increases in inverse relation to the extent to which the item is available. So it is in the case of foundry sand. Further, as a corollary to this, and something which is particularly true in the case of natural resources, the first of the known natural resources to be removed commonly is that which is the easiest to remove. Thereafter, only after that which is easiest to remove is removed is removal had of that which is more difficult to remove. Concomitantly, the price of the natural resource, e.g., foundry sand, increases in proportion to the cost of removing the natural resource, which in turn normally is a function of the degree of difficulty encountered in effecting the removal of the natural resource.

The third, which is of equal if not in some instances greater concern, that is faced by those in the foundry field is that presented by the fact that it is becoming increasingly more common to find that chemically bonded sand is no longer being accepted for disposal at local disposal sites. That is, from an ecological standpoint, environmental protection agencies on the local level are prohibiting the disposal of such chemically bonded sand at disposal sites which fall within their respective jurisdictions. Thus, those in the foundry field are in need of finding a way of accomplishing the disposal of such chemically bonded sand in a safe and legally accepted fashion.

As can be seen by reference to the prior art, there have been attempts made previously in an effort to address one or more of the above-noted concerns. In this regard, the focus of one of these prior art attempts has been on an effort to effect the reclamation of foundry sand. One rationale behind this effort has been that if it were to prove possible to effect a recycling of the foundry sand, this would go far towards forestalling the exhaustion of existing sources of supply of foundry sand. Furthermore, to the extent that recycling of the foundry sand takes place at or in relatively close proximity to the individual foundry sites whereat the use was originally made of the foundry sand, the effect thereof would be to negate substantially if not totally, the need to incur the expenses associated with the transportation of foundry sand from the sources of supply thereof to the foundry sites. In addition, the ability to reclaim used foundry sand obviates the problem associated with the need to find a suitable disposal site for the used foundry sand.

Insofar as the reclamation of used foundry sand is concerned, there are at least two major requirements, which from a practical standpoint, must be satisfied thereby. Namely, the used foundry sand after being subjected to the reclamation process must be in substantially the same condition as it originally was. That is, the reclamation process must be capable of restoring the used foundry sand to, in essence, its original condition. Secondly, the reclamation of used foundry sand must be capable of being accomplished economically. More specifically, the cost of reclamation must be such that reclamation from a financial standpoint is sufficiently attractive to render it desirable to undertake the investment in terms of time, labor and money required thereby as compared to continuing to purchase new, i.e., not previously used, foundry sand.

With respect to the matter of the reclamation of used foundry sand, a variety of different types of apparatus have been proposed for use. These apparatus may, for ease of reference, be classified into categories according to the type of treatment to which the used foundry sand is subjected for purposes of effecting the reclamation thereof. Thus, one category into which such apparatus may be placed is that of mechanical units. Here, reliance is had, generally speaking, on some form of abrasive action in order to effect the removal of, for example, organic coatings from the particles of sand. This abrasive action may be realized through the action of some sort of mechanical member, or through the use of a so-called "air scrubber". The latter refers to a type of device wherein the sand particles are accelerated to relatively high velocities by means of compressed air such that a rubbing action is caused to occur between individual particles of sand. In other instances, the sand particles after being accelerated are made to impinge against a suitably selected surface such that as a result of this impingement the coating fractures and separates from the individual sand particles. For purposes of illustration of a mechanical unit which has been proposed in the prior art for use in connection with the reclamation of foundry sand, reference may be had to U.S. Pat. No. 4,283,015, that issued on Aug. 11, 1981. This patent depicts on apparatus which is intended to be employed for purposes of removing no-bake coatings from foundry sand. At this point, it is deemed important that notice be taken of the fact that one should not gain the impression that in order for one to provide a system for effecting the reclamation of used foundry sand, one need only be concerned with the matter of removing organic coatings from sand particles. For, depending on the condition of the foundry sand that it is desired to reclaim, which in turn is a function of the manner in which the foundry sand has been used, a number of other considerations may be of equal, if not greater importance. For example, significant amounts of used foundry sand are produced during foundry operations wherein the used foundry sand is replete with organic matter, metal, dust and fines.

Attempts have been made, though, to provide systems of a mechanical type which would be commercially acceptable for use to effect the removal of organic matter, dust and fines from used foundry sand. However, the mechanical systems which have been made use of commercially to date have not, particularly in terms of their operation, proven to be entirely satisfactory from a performance standpoint. For example, an undesirable feature of such commercially available prior art forms of mechanical foundry sand reclamation systems is that they frequently suffer from an inability to effect the removal to the extent desired, of the organic matter from the foundry sand that is being reclaimed. The result, thus, is that subsequently conducted foundry operations are less cost effective, when used foundry sand that has been inadequately reclaimed is employed therein, because an additional amount of new sand must be mixed therewith.

A second category of apparatus that has been proposed for use in the prior art to effect the reclamation of used foundry sand is that of thermal units. In accord therewith, heat is employed for purposes of accomplishing the removal of organic coatings from the sand particles. By way of exemplification in this regard, there has previously been issued on Aug. 22, 1972 to the Applicant of the present invention, U.S. Pat. No. 3,685,165. The latter patent is directed in particular to an apparatus for thermally reclaiming resin coated sand.

Continuing to focus on the matter of the thermal reclamation of used foundry sand, and in particular that kind of foundry sand which has organic matter, metal, dust and fines present therein, there are a number of factors to which it is desirable that consideration be given if a thermal foundry sand reclamation system is to be provided that will prove to be viable from a commercial standpoint. More specifically, such a thermal foundry sand reclamation system must be capable of accomplishing the removal of the organic matter from the used foundry sand while at the same time leaving the metal that is also present in the used foundry sand in such a form as to enable it subsequently to be readily removed. Thus, one of the factors that must be taken into account in this regard is that of being able to provide sufficient heat to the used foundry sand so that the organic matter present therein is burned away. However, the operating characteristics of the thermal system must be such that the used foundry sand is not heated excessively, i.e., to such a high temperature that the heat produced is sufficient to effect a change in the state of the metal which is present in the used foundry sand. To this end, such a thermal system for reclaiming used foundry sand must possess the capability of enabling the organic matter to be burned away, while at the same time that this is being accomplished ensuring that the metal, be it of a ferrous or nonferrous nature, which the used foundry sand contains, is not adversely affected, i.e., rendered more difficult to remove, as a consequence of being exposed to the heat that is employed to burn away the organic matter. In this regard, note is taken here of the fact that some nonferrous metals, e.g., aluminum and zinc, have a significantly different melting temperature than do ferrous metals, and consequently must be treated differently from a temperature standpoint.

Another factor which must be borne in mind when one attempts to provide such a thermal system for reclaiming used foundry sand which contains organic matter, metal, dust and fines is that of the nature of the treatment which should be accorded to the fumes that are generated as the organic matter is being burned away. There are two aspects to this. The first is that of ensuring that such fumes do not pose a danger to the personnel who are attending to the operation of the thermal foundry sand reclamation system. The second is that of ensuring that any fumes which may be exhausted to the atmosphere do not constitute a source of pollutants. That is, that the fumes which are exhausted to the atmosphere as a consequence of the operation of such a thermal system for reclaiming used foundry sand do not violate the regulations applicable thereto as established by the local, state and federal authorities having cognizance over such matters.

The third factor to which it is essential that consideration be given in providing such a thermal foundry sand reclamation system is the matter of the cost thereof. Namely, both in terms of originally providing the system and in terms of operating the system thereafter, the expenditures required therefor must be such as to render it desirable to undertake the requisite investment as compared to the expenditure of the funds necessary to acquire new foundry sand rather than reclaimed foundry sand.

Related to this matter of cost, which is addressed in the preceding paragraph, is the matter of the production output of reclaimed foundry sand that can be realized through the use of such a thermal foundry sand reclamation system. Reference is had here to the fact that for such a thermal foundry sand reclamation system to be commercially viable, it is necessary that the system embody the capability of providing reclaimed foundry sand in the desired quantities, i.e., in amounts sufficient to meet the need therefor as it exists at any given site at which foundry operations capable of making use thereof take place.

In summary, the salient point which the preceding discussion serves to make is the fact that there already has been shown to exist in the prior art a need for a system which is operative to effect the reclamation of used foundry sand. And in particular the preceding discussion evidences the need in the prior art for a system that is operative to reclaim used foundry sand which contains metal of either a ferrous or nonferrous nature, organic matter, dust and fines. To meet this need a thermal sand reclamation system has been proposed. The latter system as well as the individual components which are embodied in this system comprise the subject matter of the five earlier filed patent applications to which reference has previously been made hereinbefore; namely, U.S. patent application Ser. No. 369,069, now U.S. Pat. No. 4,487,372; U.S. patent application Ser. No. 369,068; U.S. patent application Ser. No. 369,334, now U.S. Pat. No. 4,429,642; U.S. patent application Ser. No. 369,476, now abandoned; and U.S. patent application Ser. No. 369,335, now abandoned.

In accord with the mode of operation of the thermal sand reclamation system that comprises the subject matter of the above-enumerated U.S. Patent Applications the used foundry sand in order to accomplish the thermal reclamation thereof is required to be heated to a temperature approximating 1300° F. To this end, when the used foundry sand contains metal of a ferrous nature, it can be heated to a temperature approximating 1300° F., but when the used foundry sand contains metal of a nonferrous nature, it can not be heated to a temperature that exceeds approximately 900° F. until the nonferrous metal has been separated therefrom whereupon the used foundry sand can be heated to a temperature approximating 1300° F. Such temperatures are required in order to effect the thermal removal of organic matter from the used foundry sand. Thereafter, the used foundry sand from which the organic matter has been removed is required to be cooled to a temperature at which it no longer poses a hazard to humans. To heat the used foundry sand to the elevated temperatures noted above requires considerable energy to be expended. Conversely, when the used foundry sand is being cooled after being thermally reclaimed, the sand gives off considerable heat.

As a consequence of providing the aforereferenced system for reclaiming used foundry sand there has, therefore, also been shown to exist a need in the prior art for a new and improved form of apparatus that would be suitable for employment for purposes of effecting the preheating of the used foundry sand in preparation to the latter being subjected to the thermal removal of organic matter therefrom. That is, a need has now been evidenced for an apparatus that could be cooperatively associated with a thermal reclaimer apparatus in a thermal sand reclamation system, and which would be operative to accomplish the preheating of the used foundry sand prior to the latter being subjected to thermal reclamation, and wherein the preheating of the used foundry sand would take place as a consequence of a heat exchange between used foundry sand that is in the process of being cooled following the thermal removal of organic matter therefrom and used foundry sand which is about to have the organic matter thermally removed therefrom. It is, therefore, an object of the present invention to provide a new and improved form of apparatus for treating solid, granular and aggregate materials.

It is another object of the present invention to provide such an apparatus which is particularly suited for use in a thermal sand reclamation system for purposes of effecting the preheating of used foundry sand.

It is still another object of the present invention to provide such a preheating apparatus which can also be employed in a thermal sand reclamation system for purposes of effecting the post reclamation of used foundry sand.

A further object of the present invention is to provide such a preheating and post reclamation apparatus which can also be employed in a thermal sand reclamation system for purposes of effecting cooling of the used foundry sand.

A still further object of the present invention is to provide such a preheating, post reclamation and cooling apparatus which can be cooperatively associated in operative relation with a thermal reclaimer apparatus in a thermal sand reclamation system.

Yet a further object of the present invention is to provide such a preheating, post reclamation and cooling apparatus wherein also the amount of organic in the foundry sand is reduced by prereclamation, i.e., partial reclamation, of the foundry sand that is to be subjected to thermal reclamation.

Yet another object of the present invention is to provide such a preheating, prereclamation, post reclamation and cooling apparatus wherein any foundry sand lumps that may be left are crushed without the crushing of other friable materials such as ceramics inasmuch as the sand lumps do not have any tensile strength because of having been subjected to prereclamation.

Yet a still further object of the present invention is to provide such a preheating, prereclamation, crushing, post reclamation and cooling apparatus wherein the preheating of used foundry sand is accomplished as a consequence of a heat exchange between used foundry sand that has been subjected to thermal reclamation and used foundry sand that is to be subjected to thermal reclamation.

Yet still another object of the present invention is to provide such a preheating, prereclamation, crushing, post reclamation and cooling apparatus wherein removal of metal from the used foundry sand is accomplished therewithin before the used foundry sand is made to enter the thermal reclaimer apparatus.

Yet still an additional object of the present invention is to provide such a preheating, prereclamation, crushing, metal separation, post reclamation and cooling apparatus which is characterized in that it is easy to employ, it is reliable in operation, yet is relatively inexpensive to provide.

SUMMARY OF THE INVENTION

In accordance with the present invention, there is provided a new and improved apparatus for treating solid, granular and aggregate materials, and in particular spent, i.e., used, chemically bonded foundry sand. The subject apparatus includes a rotatable first chamber means in which the used foundry said while traveling therethrough in a first direction is preheated. The rotatable first chamber means has a rotatable second chamber means cooperatively associated therewith at the exit end thereof. Upon exiting from the first chamber means the used foundry sand enters the second chamber means. The second chamber means embodies a crushing means and a sizing means. During the course of its passage through the second chamber means the used foundry sand passes first through the crushing means wherein all friable foundry sand lumps that may be present in the used foundry sand are crushed, and then passes through the sizing means wherein any oversized material that may be present in the used foundry sand such as metal, ceramics, etc. is separated out of the sand. After leaving the sizing means the used foundry sand exits from the subject apparatus and preferably is conveyed to a thermal reclaimer apparatus, wherein the balance of the organic matter present in the used foundry sand is thermally removed therefrom. Once the used foundry said has passed through the thermal reclaimer apparatus, it again is made to enter the subject apparatus, and more specifically a fluidizing chamber means with which the latter apparatus is suitably provided. Within the fluidizing chamber means the used foundry sand continues to undergo reclamation, i.e., a post reclamation of the used foundry sand is had. In addition, as the used foundry sand travels through the fluidizing chamber means in a second direction heat is transferred therefrom to the used foundry said which is traveling in a a first direction through the first chamber means. As a consequence of this heat exchange, the used foundry sand while passing through the first chamber means becomes preheated whereas the used foundry sand while passing through the fluidizing chamber means becomes cooled. Upon exiting from the fluidizing chamber means and thereby the subject apparatus the used foundry sand is preferably conveyed to other apparatus wherein the used foundry sand is subjected to scrubbing and further cooling.

DESCRIPTION OF A PREFERRED EMBODIMENT

Figure 1:
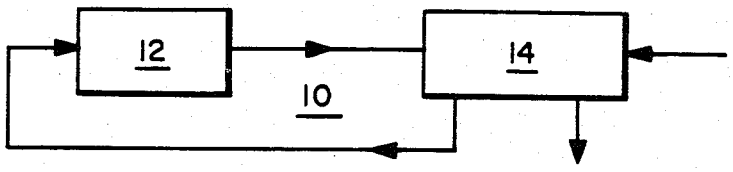
FIG. 1 is a block diagram of an assembly consisting of an apparatus with heat exchange means and transfer pipe for treating solid, granular and aggregate materials constructed in accordance with the present invention and which is depicted cooperatively associated in operative relation with a thermal reclaimer apparatus that is operative for effecting the thermal removal of organic matter from spent chemically bonded foundry sand.

Referring now to the drawing, and more particularly to FIG. 1 thereof, there is depicted therein in block diagram form an assembly 10 consisting of a thermal reclaimer apparatus, generally designated by reference numeral 12 and an apparatus with heat exchange means and transfer pipe, generally designated by reference numeral 14, for treating solid, granular and aggregate materials, constructed in accordance with the present invention. The thermal reclaimer apparatus 12 may take the form of the thermal reclaimer apparatus that comprises the subject matter of U.S. patent application Ser. No. 369,334, now U.S. Pat. No. 4,429,642, which was filed on Apr. 16, 1982 in the name of the same inventor as the present application and which is assigned to the same assignee as the present application. Accordingly, reference may be had to this issued U.S. patent for a complete description and illustration of the thermal reclaimer apparatus 12.

However, for purposes of acquiring an understanding of the subject matter of the invention to which the present patent application is directed, a brief description of the nature of the construction of the thermal reclaimer apparatus 12 follows hereinafter. To this end, the thermal reclaimer apparatus 12 includes chamber means in which the used foundry sand is heated to a predetermined temperature for a preestablished period in order to accomplish the burning away of the organic matter that the used foundry sand contains. The chamber means includes inlet means provided at one end thereof and outlet means provided at the other end thereof. Feed means are cooperatively associated with the inlet means for feeding the used foundry sand through the inlet means into the chamber means. Further, the thermal reclaimer apparatus 12 includes rotating means operative for effecting the rotation of the chamber means as the used foundry sand is being heated therein. Continuing, burner means are cooperatively associated with the chamber means at the same end thereof as that at which the output means is located. The burner means is operative to effect the heating of the used foundry sand to the desired temperature within the chamber means. Lastly, the outlet means constitutes the means through which the used foundry sand following the removal therefrom of organic matter leaves the chamber means and thereby the thermal reclaimer apparatus 12.

Figure 3:
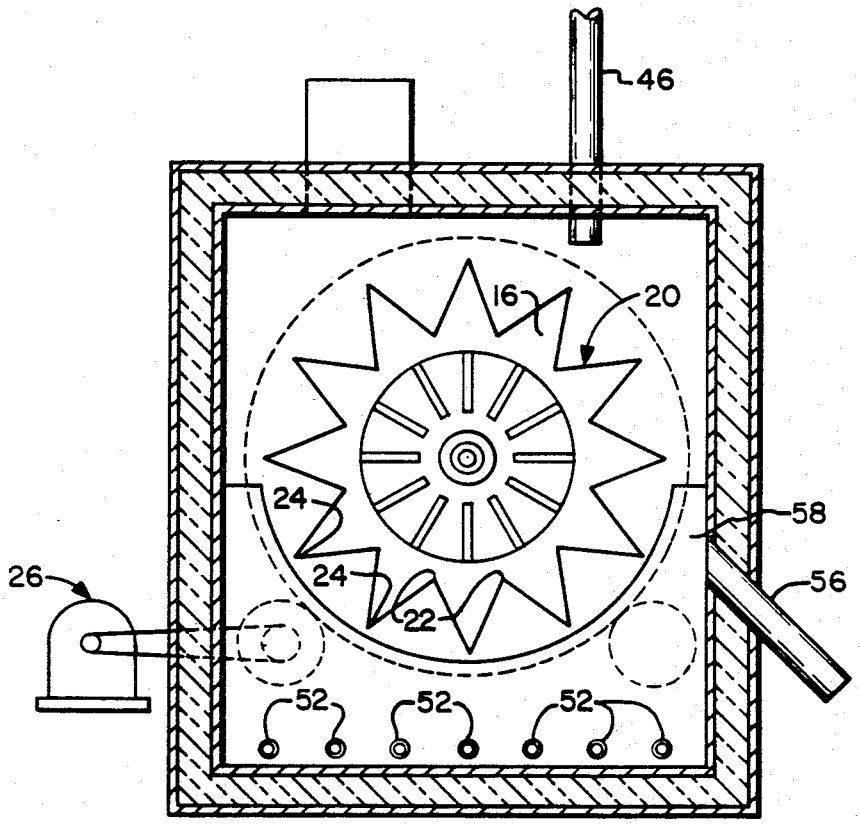
FIG. 3 is a cross-sectional view of the apparatus of FIG. 2 taken substantially along the line 3—3 in FIG. 2.
Figure 2:
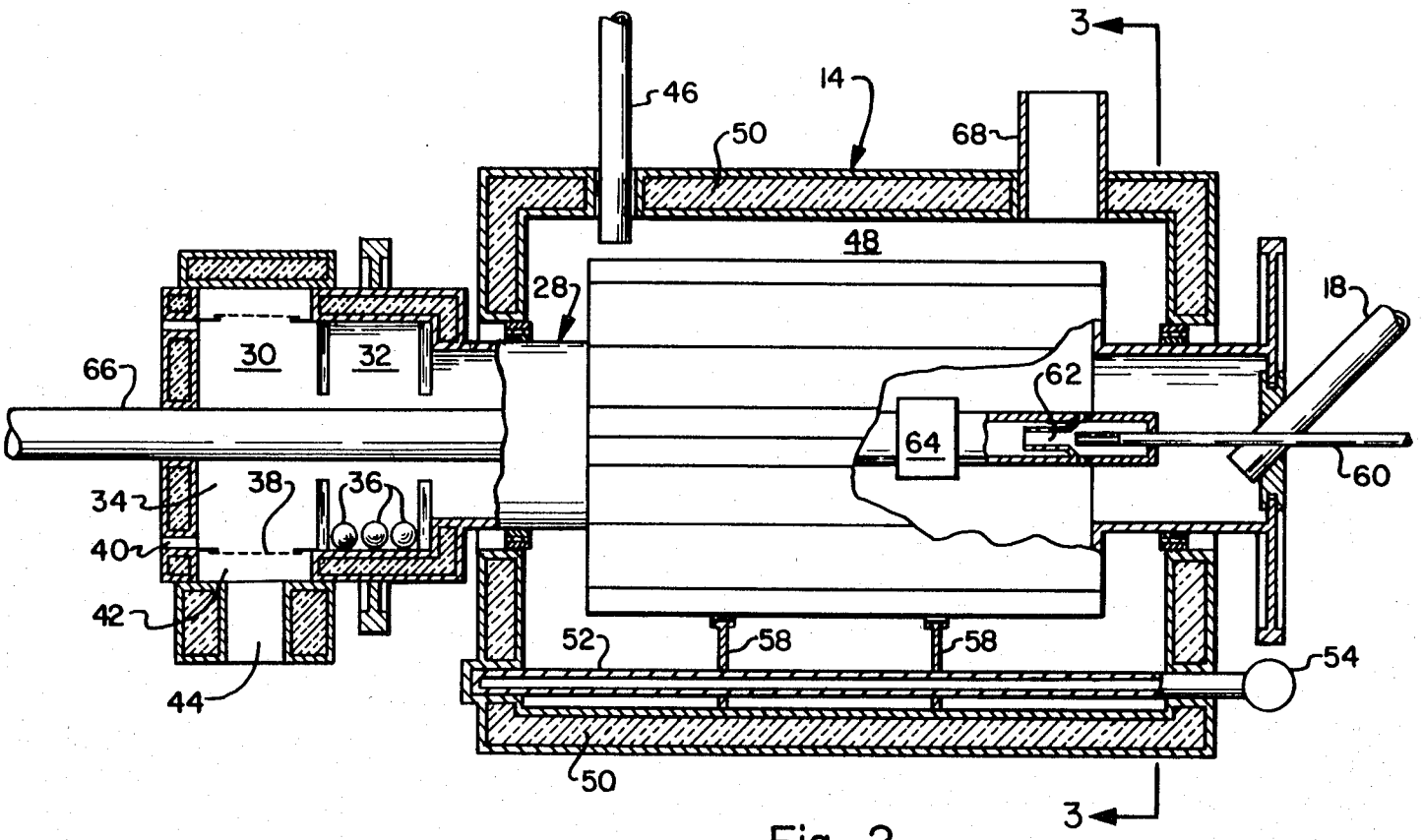
FIG. 2 is a side elevational view, in section, of an apparatus with heat exchange means and transfer pipe for treating solid, granular and aggregate materials constructed in accordance with the present invention.

Turning now to a description of the apparatus 14 with heat exchange means and transfer pipe of the present invention for treating solid, granular and aggregate materials, reference will be had for this purpose in particular to FIGS. 2 and 3 of the drawing. First, however, note is made here of the fact that the apparatus 14 of the present invention is operative to effect the preheating, prereclamation, sizing, metal separation, post reclamation and cooling of spent, i.e., used, chemically bonded foundry sand. More specifically, in a manner yet to be described the used foundry sand that is to be subjected in the thermal reclaimer apparatus 12 to the thermal removal therefrom of organic matter is preheated and prereclaimed as a consequence of the exchange of heat thereto from used foundry sand that has been subjected to the thermal removal therefrom in the thermal reclaimer apparatus 12 of organic matter.

In accord with the preferred embodiment of the invention and as best understood with reference to FIGS. 2 and 3 of the drawing, the apparatus 14 has a substantially cylindrically shaped chamber 16 formed therewithin. For a purpose and in a manner yet to be described, the chamber 16 is designed to be rotatable. Preferably, spent, i.e., used, chemically bonded foundry sand enters the chamber 16 through some form of pipe means, such as the pipe that is denoted by the reference numeral 18 in FIG. 2. It is to be understood though that some other type of means could equally well be utilized for this purpose without departing from the essence of the invention. The used foundry sand which is fed into the chamber 16 at a fixed predetermined rate, is typically at ambient temperature and has been prescreened so as to be of approximately minus three quarter inch size.

With further reference to the chamber 16, the latter as best understood with reference to FIG. 3 of the drawing has a corrugated surface, generally designated by the reference numeral 20, formed at the center thereof. More specifically, as seen with reference to FIG. 3, the internal circumference of the chamber 16 is defined by a plurality of alternating projections 22 and indentations 24. Collectively, the projections 22 and indentations 24 provide the corrugated surface referred to hereinbefore. In accord with the preferred embodiment of the invention, the projections 22 and indentations 24 extend substantially the length of the chamber 16. The function of the aforesaid corrugated surface 20 is to cause a mixing to occur of the used foundry sand as the latter traverses the length of the chamber 16, i.e., travels through the chamber 16 from the right end to the left end thereof as viewed with reference to FIG. 2 of the drawing. In addition, note is taken here of the fact that increased heat transfer is possible with the surface 20 inasmuch as the latter is corrugated.

The chamber 16 is appropriately mounted for rotation in a conventional way in bearing means, the latter taking any known form of construction that is suitable for use in this manner. To this end, the apparatus 14 may have cooperatively associated therewith any suitable conventional form of rotating means, such as the motor and drive means identified generally in FIG. 3 by the reference numeral 26. In this regard, the rotating means 26 is designed to be operative for purposes of effecting the rotation of the chamber 16 such that the used foundry sand that enters the latter by means of a pipe 18 is made to travel from one end to the other of chamber 16. Further, as noted previously herein the used foundry sand as it accomplishes this passage is mixed by virtue of the action of the corrugated surface 20. Lastly, in a manner yet to be described the used foundry sand is preheated in the course of traversing the length of the chamber 16. More specifically, the temperature of the used foundry sand continues to increase from the time the used foundry sand enters the chamber 16 to the time it exits from the latter.

After traversing the chamber 16, the used foundry sand passes through a transfer pipe, i.e., an area of reduced dimensions, generally designated by the reference numeral 28 and then into a second chamber, the latter being denoted generally in FIG. 2 by reference numeral 30. Both the transfer pipe 28 and the chamber 30 are preferably formed so as to be integral with the chamber 16 whereby the transfer pipe 28, the chamber 30 and the chamber 16 all rotate as a unit. Further, as best seen with reference to FIG. 2 of the drawing, the center lines of both the transfer pipe 28 and the chamber 30 are coincident with the center line of the chamber 16.

The chamber 30 consists of a first area 32 which suitably houses crushing means and a second area 34 wherein a sizing means is to be found located. The aforereferenced crushing means consists of the suitably dimensioned area 32 of the cylindrically shaped chamber 30 in which a multiplicity of suitably constructed balls 36 are suitably positioned so as to be movable therewithin. The balls 36 are each of sufficient weight such as to be operative for purposes of crushing any friable foundry sand lumps that may be present in the used foundry sand when the latter enters the crushing area 32 through the transfer pipe 28. In this regard, note is taken here of the fact that because of the increased temperature of the used foundry sand any lumps that may be present therein lose some of their tensile strength. Further, the crushing area 32 is subject to the same rotational movement as the chamber 16 to which reference has previously been had hereinbefore. Thus, the rotary action to which the crushing area 32 is being subjected concomitant with the movement in the area 32 of the crushing balls 36 along with the fact that the increased temperature of the used foundry sand lowers the tensile strength of the lumps that may be present in the latter sand all jointly coact for purposes of effecting the crushing of the friable foundry sand lumps in the used foundry sand. Finally, mention is made here of the fact that in a manner to which further reference will be had hereinafter, the used foundry sand while in the crushing area 32 undergoes further heating.

After being subjected to the aforedescribed crushing action, the used foundry sand leaves the crushing area 32 and enters the sifting area 34. The latter area 34 is substantially cylindrical in configuration and is provided on its outer surface with a suitably dimensioned opening. Positioned in juxtaposed relation to this opening is a suitably dimensioned screen 28. Any suitable conventional form of mounting means may be employed for purposes of emplacing the screen 38 over the aforedescribed opening in the wall of the sifting area 34. In addition, the sifting area 34 has a slot 40 provided in one of the end walls thereof for a purpose now to be described. To this end, the used foundry sand which is in the sifting area 34 undergoes a sifting action therein. That is, as the sifting area 34 rotates in the same manner as the previously described crushing area 32 and preheating chamber 16, the used foundry sand is sifted such that the sand particles which are of the desired size pass through the screen 38 and enter the collecting chamber 42 which is located, as viewed with reference to FIG. 2 of the drawing, below the screen 38. On the other hand, any oversize material that may be present in the used foundry sand such as bits of metal, ceramic, etc. are discharged from the sifting area 34 through the slot 40 whereupon the oversize material is collected in any suitable container-like means (not shown).

Continuing, the sand particles that pass through screen 38 enter the collecting chamber 42 and are discharged from the latter into a collecting chute, the latter being denoted by the reference numeral 44 in FIG. 2. As best understood with reference to FIG. 1 of the drawing, the collecting chute 44 is designed to be connected in operative relation to the thermal reclaimer apparatus 12 such that sand particles leaving the collecting chamber 42 of the apparatus 14 are conveyed through the collecting chute 44 to the thermal reclaimer apparatus 12 wherein these sand particles are subjected to further thermal reclamation. The manner in which this thermal reclamation of the sand particles is effected forms the subject matter of copending U.S. patent application Ser. No. 369,334, filed on Apr. 16, 1982, now U.S. Pat. No. 4,429,642.

Briefly, by way of a summary of the description that has been had to this point of the apparatus 14, the used foundry sand which enters the chamber 16 is at ambient temperature. While traversing the chamber 16, the temperature of the used foundry sand increases. From the chamber 16, the used foundry sand enters the crushing area 32 by means of the transfer pipe 28. In the crushing area 32, any friable foundry sand lumps that may be present in the used foundry sand are crushed largely through the action of the crushing balls 36. Also, the used foundry sand is subjected to further heating while in the crushing area 32. From the crushing area 32 the used foundry sand passes into the sifting area 34. While in the sifting area 34, the used foundry sand is sifted such that oversize material is separated out of the used foundry sand and is discharged from the sifting area 34 through the slot 40 with which the latter is suitably provided for this purpose. On the other hand, sand particles which are of the desired size pass through the screen 38 into the collecting chamber 42. Thereafter, the sand particles are discharged from the collecting chute 42 into the collecting chute 44 whereupon the sand particles are conveyed to the thermal reclaimer apparatus 12 wherein these sand particles undergo further thermal reclamation. It is to be noted here that in the course of its aforedescribed passage through the apparatus 14 the used foundry sand is preheated to a temperature approximating 800° F. and is partially reclaimed. Further, the used foundry sand has metal and refuse separated therefrom, while the sand particles thereof undergo sizing in that only those sand particles that are of the desired size will pass through the screen 38 and ultimately be conveyed to the thermal reclaimer apparatus 12 for further processing.

In the thermal reclaimer apparatus 12 the organic matter that is present in the used foundry sand is removed therefrom by being burned away. To this end, the used foundry sand is heated in the thermal reclaimer apparatus 12 to a temperature approximating 1300° F. to 1400° F. Thereafter, the used foundry said, now that the organic matter has been removed therefrom and while still at a temperature of on the order of 1400° F. or so, is made to exit from the thermal reclaimer apparatus 12 and is conveyed by means of any suitable conventional form of transport means to the apparatus 14 whereupon the used foundry sand is made to reenter the apparatus 14. As best understood with reference to FIG. 2 of the drawing, the used foundry sand after leaving the thermal reclaimer apparatus 12 may be fed to the apparatus 14 by means of the feed pipe identified in FIG. 2 by the reference numeral 46.

The used foundry sand which enters the apparatus 14 through the feed pipe 46 in addition to being at a temperature of 1400° F. is of grain size. From the feed pipe 46 the used foundry sand passes into a fluidizing chamber, identified generally by the reference numeral 48 in FIG. 2, with which the apparatus 14 is suitably provided for a purpose yet to be described. The fluidizing chamber 48 is substantially box-shaped in configuration. Further, as the apparatus 14 is made to rotate by the motor and drive means seen at 26 in FIG. 3 of the drawing, the chamber 16, is made to rotate within the fluidizing chamber 48.

With further reference to FIGS. 2 and 3 of the drawing, it can be seen therefrom that the fluidizing chamber 48 is well insulated. Namely, suitable insulation, denoted in the drawing generally by the reference numeral 50, is suitably supported through the use of any conventional form of support means in surrounding relation to the wall surfaces which serve to define the periphery of the fluidizing chamber 48. Also, as will be best understood with reference to FIGS. 2 and 3 of the drawing a plurality of fluidizing pipes 52 are mounted by means of any suitable conventional form of mounting means in equally spaced relation one to another within the fluidizing chamber 48 for a purpose yet to be described. Further, as depicted in FIG. 2, the fluidizing pipes 52 are interconnected in fluid flow relation with a main head, the latter being identified by the reference numeral 54, whereby the pipes 52 are supplied with air of a suitable pressure thereby.

As it moves through the fluidizng chamber 48, the used foundry sand is fluidized by the action of the air exiting from the fluidizing pipes 52. The level at which the fluidized used foundry sand moves through the chamber 58 is determined by the lower edge of the discharge chute, the latter being seen at 56 in both FIGS. 2 and 3 of the drawing. Moreover, as the fluidized used foundry sand travels through the chamber 48, the outer wall surface of the preheating chamber 16 is heated thereby. This heating effect is further aided by the emplacement in the fluidizing chamber 48 of baffles 58. In accord with the preferred mode of the invention, a multiplicity of baffles 58 are suitably mounted for this purpose in crosswise relation to the outside wall surface of the preheating chamber 16. To summarize, there occurs a heat exchange between the fluidized hot sand traversing the interior of the fluidizing chamber 48 and the outer wall of the preheating chamber 16 such that the hot sand heats up the outer wall of the preheating chamber 16 while the latter being cooler functions to effect a cooling of the hot sand that comes into contact therewith as the hot sand traverses the length of the fluidizing chamber 48.

Continuing, the sand particles that traverse the fluidizing chamber 48 exit therefrom through discharge chute 56. Preferably, the discharge chute 56 interconnects the apparatus 14 with other apparatus (not shown) wherein the used foundry sand after leaving the apparatus 14 is subjected to scrubbing and undergoes further cooling. Inasmuch as such other apparatus form no part of the present invention they have not been illustrated in the drawing of the instant application nor is any further description thereof had herein.

A brief summary will now be had of the description of the passage of the used foundry sand through the apparatus 14 after the used foundry sand reenters the latter through the feed pipe 46. First, however, note is taken of the fact that at the time of reentering the apparatus 14 the used foundry sand is at a temperature approximating 1400° F. While traversing the fluidizing chamber 48, the used foundry sand continues to undergo reclamation whereby organic matter in the used foundry sand is burned away. Further, as the used foundry sand passes through the fluidizing chamber 48, it becomes fluidized by virtue of the action of the air exiting from the fluidizing pipes 52. Moreover, during the passage of the fluidized hot sand through the fluidizing chamber 48, a heat exchange takes place between the used foundry sand in the chamber 48 and the outer wall surface that serves to define the preheating chamber 16. After passing through the fluidizing chamber 48, the sand particles are discharged therefrom and thereby from the apparatus 14 by means of discharge chute 56, whereupon the sand particles are conveyed to suitable other apparatus (not shown). Lastly, it is to be noted here that in the course of its passage through the apparatus 14 after reentering the latter the used foundry sand is cooled from a temperature approximating 1400° F. to a temperature approximating 350° F.

To complete the description of the apparatus 14 constructed in accordance with the present invention, note is taken here of the fact that as the used foundry sand is made to pass therethrough, fumes and dust are generated in the preheating chamber 16 of the apparatus 14. Thus, for purposes of evacuating the fumes and dust from the chamber 16 of the apparatus 14 gas is injected through the pipe identified generally by the reference numeral 60 in FIG. 2 of the drawing. This gas then flows into the venturi shaped nozzle, identified by the reference numeral 62 in FIG. 2. The effect of this flow of gas to the nozzle 62 is to create an area of reduced pressure within the chamber 16. Moreover, the burning of the gas heats up the air within the apparatus 14 and causes the fumes to oxidize. The latter process is further helped by making use of a catalytic converter seen at 64 in FIG. 2. Mention is made here of the fact that after passing through the catalytic converter 64 the gases pass through a pipe 66 which traverses the interior of the preheating chamber 16, the transfer pipe 28 and the chamber 30. The heat being radiated from the pipe 66 also assists in effecting a preheating of the used foundry sand located within the interior of the preheating chamber 16 as well as a further heating of the used foundry sand present in the transfer pipe 28 and the chamber 30. Finally, in accord with the best mode embodiment of the invention, the exhaust from the pipe 66 is made to flow to a heat exchanger (not shown) and therefrom to a conventional baghouse (not shown). Also, the dust that is generated by the fluidizing process which takes place in the fluidizing chamber 48 is exhausted therefrom through the exhaust pipe 68 to a baghouse (not shown). Thus, from the above description it can be seen that by virtue of the aforedescribed structure the fumes are oxidized, the dust is collected and conveyed to a baghouse, and the heat that is released is used in connection with the processing of the used foundry sand in the apparatus 14. Therefore, in accordance with the present invention there has been provided a new and improved form of apparatus for treating solid, granular and aggregate materials. However, the subject apparatus of the present invention is particularly suited for use in a thermal sand reclamation system for purposes of effecting the preheating and partial reclamation of used foundry sand. Also, in accord with the present invention a preheating apparatus is provided which can also be employed in a thermal sand reclamation system for purposes of effecting the post reclamation of used foundry sand. In addition, the subject preheating and post reclamation apparatus of the present invention can also be employed in a thermal sand reclamation system for purposes of effecting cooling of the used foundry sand. Further, in accordance with the present invention a preheating, post reclamation and cooling apparatus is provided which can be cooperatively associated in operative relation with a thermal reclaimer in a thermal sand reclamation system. Additionally, the subject preheating, post reclamation and cooling apparatus of the present invention is operative such that the amount of organic in the foundry sand is reduced by prereclamation, i.e., partial reclamation of the foundry sand that is to be subjected to thermal reclamation. Furthermore, in accordance with the present invention a preheating, prereclamation, post reclamation and cooling apparatus is provided wherein any foundry sand lumps that may be left are crushed without the crushing of other friable materials such as ceramics, inasmuch as the sand lumps do not have any tensile strength because of having been subjected to prereclamation. Penultimately, the subject preheating, prereclamation, crushing, post reclamation and cooling apparatus is operative in such a manner that the preheating of the used foundry sand is accomplished as a consequence of a heat exchange between used foundry sand that has been subjected to further thermal reclamation and used foundry sand that is to be subjected to further thermal reclamation. Lastly, in accordance with the present invention a preheating, prereclamation, crushing, metal separation, post reclamation and cooling apparatus is provided which is characterized in that it is easy to employ, is reliable in operation, yet is relatively inexpensive to provide.

While only one embodiment of my invention has been shown, it will be appreciated that modifications thereof, some of which have been alluded to hereinabove, may still be readily made thereto by those skilled in the art. I, therefore, intend by the appended claims to cover the modifications alluded to herein as well as all other modifications, which fall within the true spirit and scope of my invention.

I claim:

1. An apparatus for effecting the preheating, prereclamation, crushing, sizing, post reclamation and cooling of used foundry sand comprising:

a. a preheating and prereclamation chamber including inlet means provided adjacent one end thereof and outlet means provided adjacent the other end thereof, said inlet means providing an entrance to said preheating and prereclamation chamber for used foundry sand supplied thereto at a first temperature, said preheating and prereclamation chamber having a corrugated interior surface and being operative to retain the used foundry sand therewithin while the used foundry sand is being both preheated to a second temperature and prereclaimed during the course of the passage thereof in a first direction through said preheating and prereclamation chamber, said corrugated interior surface being operative for purposes of effecting a mixing of the used foundry sand during the passage thereof through said preheating and prereclamation chamber and for purposes of providing said preheating and prereclamation chamber with increased heat transfer surface, said outlet means providing an exit from said preheating and prereclamation chamber for the used foundry sand following the preheating thereof to the second temperature and the prereclamation thereof in said preheating and prereclamation chamber;

b. a transfer chamber having one end thereof cooperatively associated with said outlet means of said preheating and prereclamation chamber for receiving the used foundry sand while at the second temperature from said preheating and prereclamation chamber, said transfer chamber being of lesser dimensions than said preheating and prereclamation chamber and having its longitudinal axis coincident with the longitudinal axis of said preheating and prereclamation chamber;

c. a crushing and sizing chamber having one end thereof cooperatively associated with the other end of said transfer chamber for receiving the used foundry sand while at the second temperature therefrom and having its longitudinal axis coincident with the longitudinal axis of said transfer chamber, said crushing and sizing chamber including a crushing area and a sizing area, said crushing area having a multiplicity of balls housed therewithin, said multiplicity of balls being operative to effect the disintegration of friable lumps of used foundry sand during the passage of the used foundry sand through said crushing area of said crushing and sizing chamber, said sizing area having an opening formed therewithin and including screen means positioned over said opening, said screen means being operative to sift the used foundry sand during the passage thereof through said sizing area of said crushing and sizing chamber so as to effect a separation of oversize particles of used foundry sand from particles of used foundry sand of desired size;

d. post reclamation and cooling chamber having reentry means formed adjacent one end thereof and discharge means formed adjacent the other end thereof, said reentry means providing an entrance to said post reclamation and cooling chamber for used foundry sand supplied thereto at a third temperature, said post reclamation and cooling chamber being operative to retain the used foundry sand therewithin while the used foundry sand undergoes cooling during the course of the passage thereof in a second direction through said post reclamation and cooling chamber, said post reclamation and cooling chamber being positioned in surrounding relation to said preheating and prereclamation chamber such that by virtue of the heat transfer between the used foundry sand during the course of the passage thereof while at the third temperature through said post reclamation and cooling chamber and the used foundry sand during the course of the passage thereof while at the first temperature through said preheating and prereclamation chamber the used foundry sand within said preheating and prereclamation chamber while traversing said preheating and prereclamation chamber in the first direction is preheated from the first temperature to the second temperature and the used foundry sand within said post reclamation and cooling chamber while traversing said post reclamation and cooling chamber in the second direction is cooled from the third temperature to the fourth temperature, said discharge means providing an exit from said post reclamation and cooling chamber for the used foundry sand following the cooling thereof within said post reclamation and cooling chamber from the third temperature to the fourth temperature; and e. rotating means cooperatively associated with said preheating and prereclamation chamber, said crushing and sizing chamber, and said transfer chamber, said rotating means being operative to effect the rotation in unison of said preheating and prereclamation chamber as the used foundry sand traverses said preheating and prereclamation chamber in the first direction, said transfer chamber as the used foundry sand traverses said transfer chamber in the first direction, and said crushing and sizing chamber as the used foundry sand traverses said crushing and sizing chamber.

2. The apparatus as set forth in claim 1 wherein said crushing and sizing chamber has a slot formed therein adjacent said screen means of said sizing area, said slot enabling oversize particles of used foundry sand to be discharged therethrough from said crushing and sizing chamber.

3. The apparatus as set forth in claim 1 wherein said post reclamation and cooling chamber further includes a plurality of fluidizing pipes supported therewithin, each of said plurality of fluidizing pipes having one end thereof connected in fluid flow relation to a source of pressurized air, said plurality of fluidized pipes being operative to discharge air therefrom so as to impart a fluidizing action to the used foundry sand within said post reclamation and cooling chamber.

4. The apparatus as set forth in claim 1 wherein said preheating and prereclamation chamber, said transfer chamber and said crushing and sizing chamber each have gas means extending therethrough, said gas means being operative to heat by radiation the used foundry sand present within said preheating and prereclamation chamber, said transfer chamber and said crushing and sizing chamber.

5. The apparatus as set forth in claim 4 wherein a catalytic converter is connected in operative relation to said gas means, said catalytic converter being operative to effect an oxidation of the fumes in said preheating and prereclamation chamber.

6. The apparatus as set forth in claim 5 wherein a venturi-shaped nozzle is connected in operative relation to said gas means, said venturi-shaped nozzle being operative to effect the establishment of an area of reduced pressure within said preheating and prereclamation chamber.

7. The apparatus as set forth in claim 1 wherein said rotating means comprises motor and drive means.

* * * * *